United States Patent [19]

Corle

[11] Patent Number: 4,932,666

[45] Date of Patent: Jun. 12, 1990

[54] METHOD OF PLAYING A TRAVEL BOARD GAME

[76] Inventor: Kenneth R. Corle, 1601 W. Maple Ave., Langhorne, Pa. 19047

[21] Appl. No.: 396,054

[22] Filed: Aug. 21, 1989

[51] Int. Cl.[5] ..... A63F 3/00; A63F 9/18

[52] U.S. Cl. ..... 273/249; 273/256; 273/251

[58] Field of Search ..... 273/249-254, 273/243, 256

[56] References Cited

U.S. PATENT DOCUMENTS

| | | | |
|---|---|---|---|
| 387,220 | 8/1888 | Forker | 273/296 |
| 2,128,608 | 8/1938 | Goertemiller | 273/251 |
| 4,029,320 | 6/1977 | Hausman | 273/288 |
| 4,109,918 | 8/1978 | Mele et al. | 273/256 |
| 4,124,214 | 11/1978 | Pavis | 273/249 |
| 4,201,388 | 5/1980 | Cantelon | 273/251 |
| 4,411,432 | 10/1983 | Stevens | 273/251 |
| 4,557,485 | 10/1985 | Lardon | 273/249 |
| 4,643,429 | 2/1987 | Crandon et al. | 273/251 |
| 4,784,394 | 11/1988 | Sumin | 273/251 |

FOREIGN PATENT DOCUMENTS

| | | | |
|---|---|---|---|
| 2198361 | 6/1988 | United Kingdom | 273/249 |

*Primary Examiner*—Benjamin Layno
*Attorney, Agent, or Firm*—Jerry T. Kearns

[57] ABSTRACT

A travel board game includes a generally rectangular game board having a movement path indicated by more than one hundred twenty contiguous sequential spaces. A first group of question spaces are designated by indicia on the movement path and a corresponding first group of question cards bear questions and associated answers corresponding to the first group of question spaces. A second group of spaces on the movement path bear indicia designating special question spaces and a second group of special question cards bear questions and answers corresponding to the special question spaces which have a higher degree of difficulty than the first group of question cards. One of the spaces on the game board is designated as a random movement space and every tenth space in the movement path is numbered, beginning at twenty and ending at one hundred twenty. Any player landing on the random movement space must move their game marker to a numbered space determined by ten times the dice total on their next subsequent turn. A map of a selected geographical area is provided on the game board, and the question cards bear questions relating to history and geography of the selected geographical area.

1 Claim, 3 Drawing Sheets

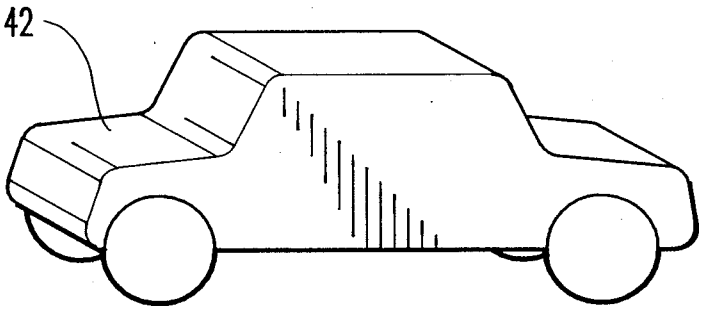
Fig. 3
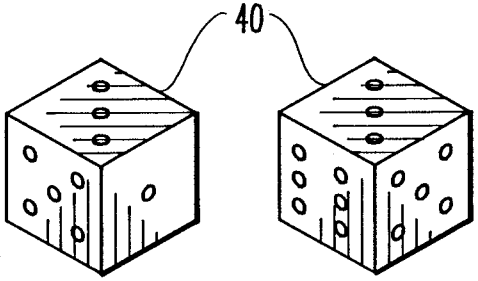
Fig. 2
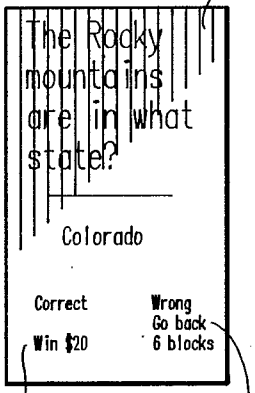
Fig. 5
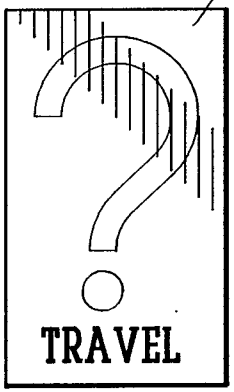
Fig. 6
Fig. 4

METHOD OF PLAYING A TRAVEL BOARD GAME

BACKGROUND OF THE INVENTION

1. Field of the Invention

The present invention relates to travel board games, and more particularly pertains to a travel board game which is designed to provide an amusing and educational board game to inform game players of historical and geographical information related to a selected geographical area.

2. Description of the Prior Art

Various types of travel board games are known in the prior art. A typical example of such a travel board game is to be found in U.S. Pat. No. 2,128,608, which issued to C. Goertemiller on Aug. 30, 1938. This patent discloses a board game having a movement path formed by a sequential group of contiguous spaces. Game markers, game cards, dice and play money are utilized in the game. U.S. Pat. No. 4,201,388, which issued to R. Cantelon on May 6, 1980, discloses a board game including a game board having a movement path formed by a plurality of contiguous sequential spaces. U.S. Pat. No. 4,411,432, which issued to R. Stevens on Oct. 25, 1983, disclose a travel board game including a game board displaying a map of a geographical area with a plurality of locations linked by travel routes marked with travel distances. A plurality of game markers are moved between the indicated locations in accordance with the roll of dice. U.S. Pat. No. 4,643,429, which issued to P. Crandon et al on Feb. 17, 1987, discloses an educational board game having a game board bearing a map of a geographical area. Question cards and dice are utilized to determine movement of game markers along the game board. U.S. Pat. No. 4,784,394, which issued to V. Sumin on Nov. 15, 1988, discloses a board game designed to guide and educate players about the geography, transportation, historical, social, entertainment and amusement interests in combination with the shopping, restaurants and hotel accommodations available in a particular geographic area.

While the above mentioned devices are directed to travel board games, none of these devices disclose a travel board game including a game board bearing indicia on selected spaces of a movement path which correspond to first and second groups of question cards bearing questions of different degrees of difficulty. Additionally, none of the aforesaid board games include a game board having a movement path formed by more than one hundred twenty sequential contiguous spaces, with every tenth space from twenty to one hundred twenty being numbered and associated with a random movement space to which a player's game marker is moved in accordance with ten times the total indicated by a pair of dice. Inasmuch as the art is relatively crowded with respect to these various types of travel board games, it can be appreciated that there is a continuing need for and interest in improvements to such travel board games, and in this respect, the present invention addresses this need and interest.

SUMMARY OF THE INVENTION

In view of the foregoing disadvantages inherent in the known types of travel board games now present in the prior art, the present invention provides an improved travel board game. As such, the general purpose of the present invention, which will be described subsequently in greater detail, is to provide a new and improved method of playing travel board game which has all the advantages of the prior art travel board games and none of the disadvantages.

To attain this, a representative embodiment of the concepts of the present invention is illustrated in the drawings and makes use of a travel board game which includes a generally rectangular game board having a movement path indicated by more than one hundred twenty contiguous sequential spaces. A first group of question spaces are designated by indicia on the movement path and a corresponding first group of question cards bear questions and associated answers corresponding to the first group of question spaces. A second group of spaces on the movement path bear indicia designating special question spaces and a second group of special question cards bear questions and answers corresponding to the special question spaces which have a higher degree of difficulty than the first group of question cards. One of the spaces on the game board is designated as a random movement space and every tenth space in the movement path is numbered, beginning at twenty and ending at one hundred twenty. Any player landing on the random movement space must move their game marker to a numbered space determined by ten times the dice total on their next subsequent turn. A map of a selected geographical area is provided on the game board, and the question cards bear questions relating to history and geography of the selected geographical area.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved travel board game which has all the advantages of the prior art travel board games and none of the disadvantages.

It is another object of the present invention to provide a new and improved travel board game which may be easily and efficiently manufactured and marketed.

It is a further object of the present invention to provide a new and improved travel board game which is of a durable and reliable construction.

An even further object of the present invention is to provide a new and improved travel board game which is susceptible of a low cost of manufacture with regard to both materials and labor, and which accordingly is then susceptible of low prices of sale to the consuming public, thereby making such travel board games economically available to the buying public.

Still yet another object of the present invention is to provide a new and improved travel board game which provides in the apparatuses and methods of the prior art some of the advantages thereof, while simultaneously overcoming some of the disadvantages normally associated therewith.

Still another object of the present invention is to provide a new and improved travel board game to provide an amusing and educational format related to the history and geography of a selected geographical area.

Yet another object of the present invention is to provide a new and improved travel board game having a novel manner of game marker movement along a race track type game board.

Even still another object of the present invention is to provide a new and improved method of playing a travel board game which allows game players to determine their success in accordance with chance and knowledge.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a perspective view illustrating a pair of dice utilized in the play of the game of the present invention.

FIG. 3 is a perspective view illustrating a sample game marker for movement around a movement path on the game board of the present invention.

FIG. 4 illustrates the back face of a first group of question cards.

FIG. 5 illustrates the front face of a selected one of a first group of question cards.

FIG. 6 illustrates the back face of a second group of special question cards.

DESCRIPTION OF THE PREFERRED EMBODIMENT

Figure 1:
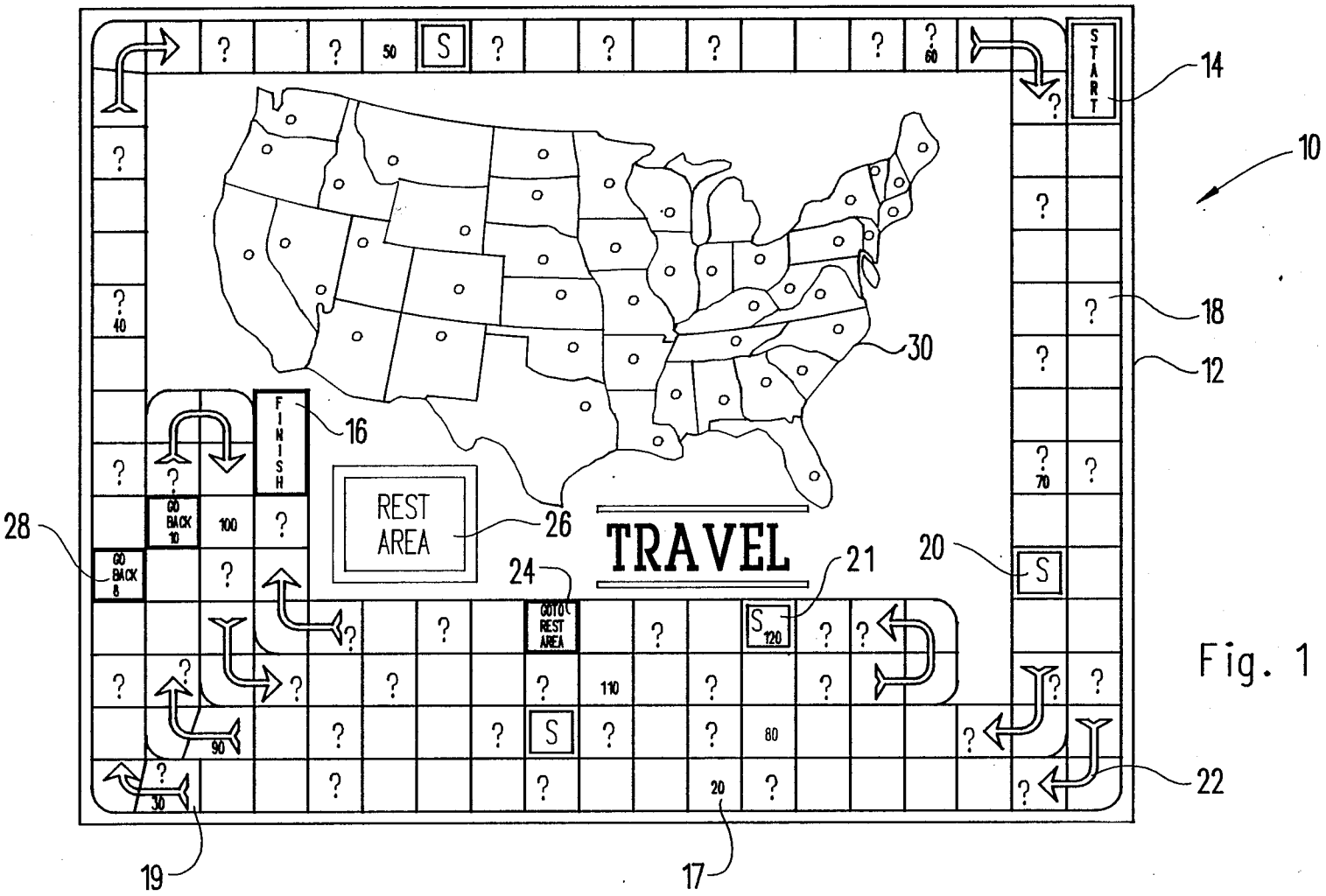
FIG. 1 is a plan view illustrating the game board of the game of the present invention.

With reference now to the drawings, and in particular to FIG. 1 thereof, a new and improved travel board game embodying the principles and concepts of the present invention and generally designated by the reference numeral 10 will be described.

More specifically, it will be noted that the first embodiment 10 of the invention includes a generally rectangular game board 12 having a movement path formed by more than one hundred twenty contiguous sequential spaces. An initial space 14 is designated as a start space and a final space 16 is designated as a finish space. A plurality of arrows 22 indicate a forward direction of movement about the movement path on the game board. Every tenth space is numbered, beginning at space twenty, indicated by reference numeral 17, and ending at space one hundred twenty, designated by reference numeral 21. Space number thirty is designated by reference numeral 19. A first group of spaces forming the game board movement path, for example the space indicated by reference numeral 18, has a "?" question mark symbol indicia designating a question space. A second group of spaces on the movement path, for example the space designated by reference numeral 20, has a "S" indicia designating a special question space. A third group of spaces, for example the space designated by reference numeral 28, bears indicia designating a movement penalty space. For example, the space referenced by numeral 28 has a "GO BACK EIGHT SPACES" penalty. A map 30 of a selected geographical area, for example, THE UNITED STATES, is formed in a generally central location on the game board 12.

As shown in FIG. 2, a pair of dice 40 are utilized to control movement of game markers around the movement path on the game board.

FIG. 3 illustrates a sample game marker 42. It should be noted that a plurality of game markers, corresponding to the number of players, will be provided. The game markers may be formed in different shapes, or in different colors, to distinguish between players.

FIG. 4 illustrates the back face of a sample card 44 of a first group of question cards. The back face of the card 44 bears a "?" question mark symbol, corresponding to the indicia associated with each of the first group of question spaces 18 on the game board movement path (FIG. 1).

As shown in FIG. 5, the front face of each of the first group of question cards 44 is provided with a question and an associated answer. The questions are preferably related to the history or the geography of the map of the selected geographical area 30 displayed on the game board 12 (FIG. 1). Indicia 45 designates a monetary award associated with a correct answer. Indicia 47 designates a movement penalty associated with a wrong answer. It should be noted that the particular question illustrated is intended to be exemplary only, and a wide variety of questions in various categories may be utilized. Sample question categories include capital cities, national parks, Indian tribes, the civil war, presidents, and general geographical questions. Additionally, the spelling of various cities and states may form sample questions. A large number of the cards 44 are preferably provided with the game, to afford sufficient diversity It is contemplated that at least one hundred fifty different question cards 44 will be provided. It is additionally contemplated that a third group of cards will be randomly intermixed with the first group of cards 44 and will each bear indicia indicating various travel problems and associated monetary penalties. Example travel penalty cards include "traffic violation—failure to yield—$30", "mechanical breakdown—need new transmission—$500", "traffic violation—speeding ticket—$30", etc.

FIG. 6 illustrates the back face of a second group of special question cards 46, which bear indicia in the form of an "S", corresponding to the indicia on the special question spaces 20 of the game board movement path (FIG. 1).

Figure 7:
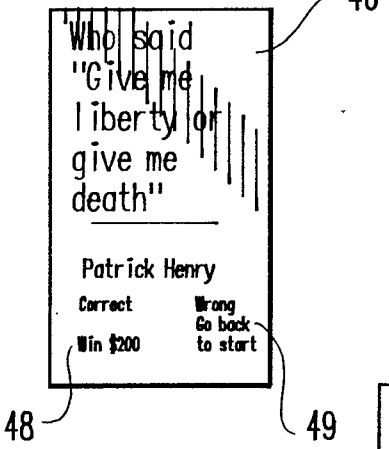
FIG. 7 illustrates a front face of a selected one of a second group of question cards.

FIG. 7 illustrates a sample question provided on the front face of special question card 46. The questions on each of the special question cards 46 are selected to have a greater degree of difficulty than the questions provided on the first group of question cards 44 illustrated in FIGS. 4 and 5. Indicia 48 and 49 on the front face of each of the special question cards 46 corresponds to a monetary award or movement penalty associated with a correct or wrong answer of the question. The monetary awards and movement penalties on the special question cards 46 are substantially greater than the penalties associated with the first group of question cards 44. It is contemplated that a large number of question cards 46 will be provided, each bearing a different question to provide sufficient diversity of play.

Figure 8:
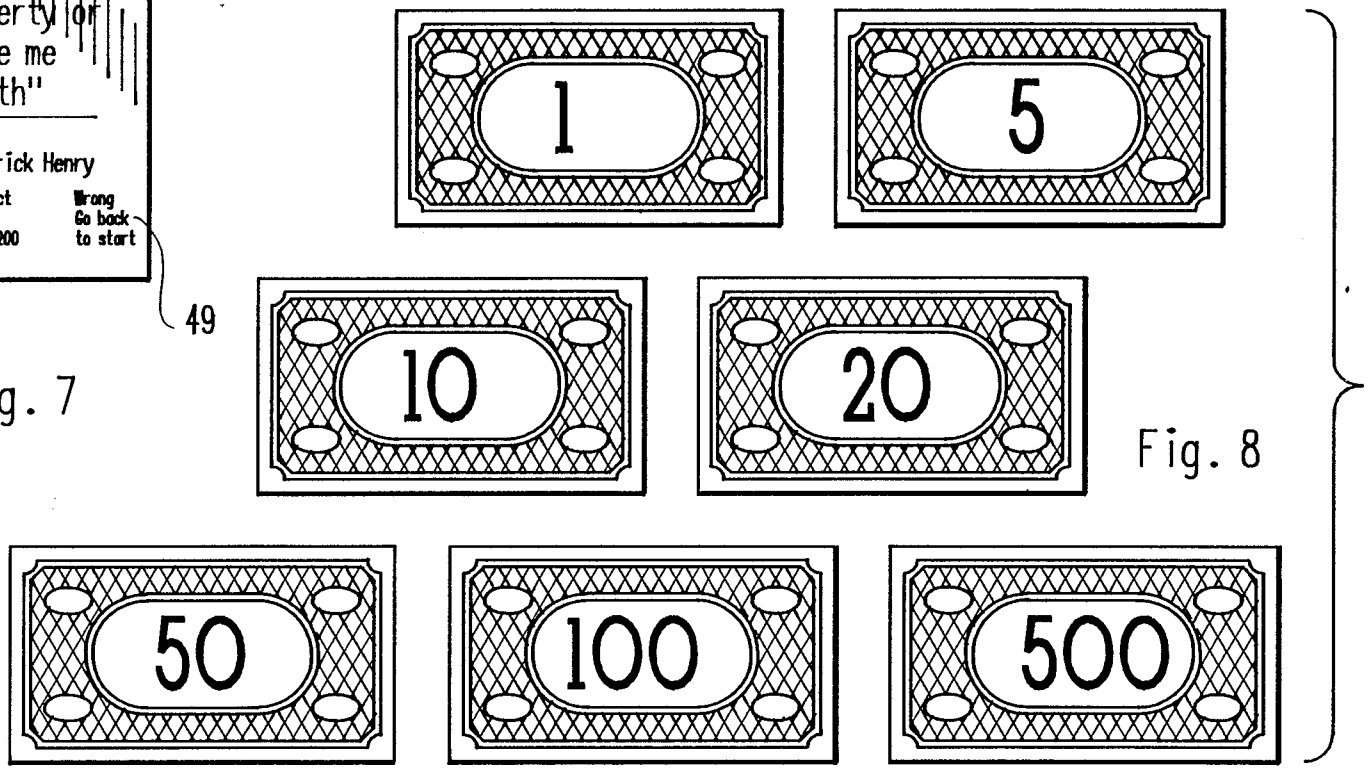
FIG. 8 illustrates play money in various denominations utilized in the game of the present invention.

FIG. 8 illustrates a quantity of play money in various different denominations associated with the play of the game.

With reference now to FIG. 1, the manner of play of the game of the present invention will now be described. A group of game players, which may be children or adults in a number from two to ten initially select their particular game marker 42 (FIG. 3). A quantity of play money, for example $1,000, in different denominations is distributed to each player. The first player then rolls the dice 40 (FIG. 2) to determine the movement of their game marker along the movement path, beginning at the start space 14. If any player lands on one of the first group of question spaces 18 indicated by the "?" indicia, one of the other players draws a card from the stack of randomly intermixed question and travel penalty cards 44 illustrated in FIGS. 4 and 5, and then asks the associated question. If the player correctly answers the question, he receives the indicated monetary award If the question is incorrectly answered, he is assessed the associated movement penalty. It should be noted that the particular awards and penalties may include both monetary and movement awards and monetary and movement penalties. If any player lands on one of the special question spaces 20 bearing the "S" indicia, the player is asked a more difficult question by an opposing player who draws a card from a stack of the special question cards 46 illustrated in FIGS. 6 and 7. Again, if the player correctly answers the question, he is awarded the associated award or assessed the associated penalty for an incorrect answer. Any player landing on the random movement space 24 must immediately move their game marker to the rest area 26. On the next subsequent turn, the player rolls the dice and moves their game marker to one of the squares, for example 17 and 19, which are numbered by ten, beginning at space twenty and ending at space one hundred twenty. The dice total is multiplied by ten to indicate the associated space. For example, a player rolling a dice total of two would move to the space indicated by reference numeral 17 and numbered twenty. Any player landing on one of the movement penalty spaces 28, is immediately assessed the indicated movement penalty in a reverse direction along the movement path. Play continues in a sequential fashion, until one player reaches the finish space 16. It should be noted that to successfully finish, a player must exactly land on the space 16. If a player reaches the finish space 16, with a remaining unconsumed count from the dice total, they must complete movement of their game marker in a reverse direction from the finish space 16, until the entire dice total has been consumed The winner of the game may be determined in several different manners, without departing from the scope of the present invention For example, the first player exactly landing on the finish space 16 may be determined the winner. Alternatively, play may continue until all players have exactly landed on the finish space 16, and the winner determined by the player having the greatest monetary total.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A method of playing a travel board game, comprising the steps of providing:

a generally rectangular game board, said game board having a movement path formed by more than one hundred twenty contiguous sequential spaces, every tenth space numbered beginning at twenty and ending at one hundred twenty;

a first group of said spaces each bearing indicia designating a question space;

a second group of said spaces each bearing indica designating a special question space;

a third group of said spaces each bearing indica designating a movement penalty space;

a selected one of said spaces bearing indicia designating a random movement space;

an initial one of said spaces bearing indicia designating a start space;

a final one of said spaces bearing indicia designating a finish space;

a map of a selected geographical area on said game board;

a plurality of game markers for movement about said movement path by game players;

a pair of dice for determining movement of said game markers about said movement path;

a quantity of play money in various denominations;

a first group of question cards, each of said cards bearing various questions and answers related to history and geography of said selected geographical area, each of said cards having indicia designating a monetary award associated with a correct answer and a movement penalty associated with a wrong answer;

a second group of question cards, each of said second group of cards bearing various questions and answers related to history and geography of said selected geographical area and having a greater difficulty than said questions on said first group of said question cards, each of said second group of cards having indicia designating a monetary award associated with a correct answer and a movement penalty associated with a wrong answer, said monetary award and movement penalty on each of said second group of cards being greater than said monetary award and movement penalty on each of said first group of cards;

a third group of cards randomly intermixed with said first group of cards and bearing indicia indicating various travel problems and associated monetary penalties;

distributing a predetermined equal quantity of said play money to each of a plurality of game players;

sequentially rolling said dice by game players in moving respective game markers around said movement path in accordance with said dice;

asking any player whose game marker lands on one of said question spaces a question selected by drawing from a stack of said randomly intermixed first and second group of cards and awarding an award or penalty determined by indicia on the selected card depending on a correct or wrong answer by the player;

asking any player whose game marker lands on one of said special question spaces a question selected by drawing from a stack of said second group of question cards and awarding an award or penalty determined by indicia on the selected card depending on a correct or wrong answer by the player;

any player whose game marker lands on said random movement space moving their game marker to one of said spaces numbered by ten from twenty to one hundred twenty, as determined by ten times the dice total on their next subsequent turn; and continuing sequential play and movement of game markers around said movement path from said start space to said finish space, any player whose game marker lands on said finish space without moving the entire number of spaces indicated by the dice total moving their game marker in reverse direction along said movement path to consume the remaining dice total.

* * * * *